United States Patent [19]

Thompson

[11] 4,290,650

[45] Sep. 22, 1981

[54] SUBTERRANEAN CAVITY CHIMNEY DEVELOPMENT FOR CONNECTING SOLUTION MINED CAVITIES

[75] Inventor: Robert E. Thompson, Moose Jaw, Canada

[73] Assignee: PPG Industries Canada Ltd., Regina, Canada

[21] Appl. No.: 63,220

[22] Filed: Aug. 3, 1979

[51] Int. Cl.[3] ..... E21B 43/28

[52] U.S. Cl. ..... 299/4

[58] Field of Search ..... 299/4, 5

[56] References Cited

U.S. PATENT DOCUMENTS

| | | | |
|---|---|---|---|
| 2,772,868 | 12/1956 | Brandt | 299/5 |
| 3,096,969 | 7/1963 | Edmonds et al. | 299/4 |
| 3,366,419 | 1/1968 | Pasternak et al. | 299/5 |
| 3,402,965 | 9/1968 | Dahms et al. | 299/4 |
| 3,574,402 | 3/1969 | Davis et al. | 299/5 |
| 3,596,992 | 8/1971 | Dietz | 299/5 |
| 3,716,272 | 2/1973 | Davis | 299/5 |
| 3,941,422 | 5/1974 | Henderson | 299/4 |

*Primary Examiner*—Ernest R. Purser

*Attorney, Agent, or Firm*—Irwin M. Stein; Walter M. Benjamin

[57] ABSTRACT

Disclosed is a method of connecting two or more subterranean cavities in a deposit having a potassium chloride-rich stratum which contains sodium chloride and which is disposed above a potassium chloride-lean, sodium chloride-rich stratum. The method comprises drilling at least two adjacent wells into the sodium chloride-rich stratum, establishing a chimney filled with insulating fluid at the bottom of at least one of the wells, extracting ore from the potassium chloride-lean stratum with solvent, raising the roof of the cavities by incrementally raising the insulating fluid level and allowing the cavities to grow laterally until the cavities connect.

13 Claims, 4 Drawing Figures

SUBTERRANEAN CAVITY CHIMNEY DEVELOPMENT FOR CONNECTING SOLUTION MINED CAVITIES

This invention relates to a method of connecting subterranean solution mined cavities and more particularly relates to developing a chimney in the cavities to aid in the connection and even more particularly relates to connecting the cavities in a stratum containing potassium chloride.

Potassium chloride usually occurs in mineral deposits closely associated with sodium chloride. Often, potassium chloride exists in a mixture or in combination with sodium chloride in the form of a salt deposit having a plurality of strata of various potassium chloride to sodium chloride ratios. A typical potassium chloride-rich stratum may contain from about 15 to about 60 percent or more by weight potassium chloride, based on the total weight of potassium chloride and sodium chloride in the stratum.

These mineral deposits usually contain other substances such as clay, sulfates and chlorides of calcium and magnesium, and the like. However, these salts are often found in small quantities, e.g., up to about 15 weight percent, but most frequently about 1 to 2 percent. These deposits are also usually very deep, e.g., greater than about 700 meters deep, and can be found in New Mexico, Utah, northern United States, Canada as well as other parts of the world.

Often a potassium chloride-rich stratum is disposed immediately above another stratum lean as to potassium chloride, i.e., containing less than about 15 percent potassium chloride on the aforesaid potassium chloride-sodium chloride basis. In order to solution mine the potassium chloride-rich stratum, a well is drilled through it and into thepotassium chloride-lean stratum or where potassium chloride is substantially non-existent and where sodium chloride is comparatively high. Water or an aqueous solution unsaturated as to sodium chloride is introduced down the cased well bore, either through a conduit disposed in the well or through the annulus between the conduit and the casing, and the potassium chloride-lean sodium chloride-rich stratum is mined to create a cavity.

In order to cause the cavity to grow laterally, a water-immiscible non-dissolving fluid such as air, nitrogen, but preferably a liquid which has a density lower than that of water, such as hydrocarbons, is introduced into the cavity in order to establish a solvent immiscible insulating blanket at the roof of the cavity. This causes the cavity to grow laterally since the roof and floor (the floor is insulated by insolubles and saturated brine) is insulated.

Two or more such cavities are developed and lateral expansion is allowed in both cavities at approximately the same level to effect connection. This is usually accomplished by injecting solvent into the cavities at an upper level near the top and withdrawing enriched solution from near the bottom of the cavity while the cavity roof insulating fluid is in place. This top injection effects rapid lateral growth at the top of the cavity adjacent the bottom of the insulating fluid. Hence, where the roof levels of both cavities are controlled at approximately the same depth, cavity connection is accomplished.

This method of cavity connection has several advantages. It initially develops the cavities to be connected in the potassium chloride-lean, sodium chloride-rich stratum where dissolving rates are rapid. A relatively large cavity is created before raising the roof into the potassium chloride-rich stratum. Thus, crystals that may form from intrinsic crystallization and crystals of insoluble impurities can settle to the bottom of the cavity without disturbing or hindering contact of incoming solvent with the walls of the cavity. Also, the large body of brine can satisfy the heat load occurring as a consequence of dissolving potassium chloride. Hence, plugging of the withdrawal conduit is minimized. Finally, because of a large dissolving face, slow dissolving potassium chloride can be extracted at commercially attractive rates.

However, this method of connecting cavities does have its drawbacks. Difficulty is often encountered in maintaining the insulating fluid blanket at the roof of the cavity. Inadvertently, the fluid blanket becomes thin owing to a pocket or fault; the fluid blanket is lost owing to disturbance of the blanket around the well bore; or the fluid blanket is maintained inadequately simply because its thickness is difficult to monitor. Consequently, roof control is lost and the "morning glory" shape cavity is developed. Once the cavity roof takes the morning glory shape, connection becomes expensive. First of all, the time value of investment in drilling and materials is lost for the extra time necessary for connection. Secondly, regaining of control of the roof may require large volumes, e.g., thousands of gallons of liquid blanket fluid, which may ultimately be ineffective. Lastly, the lateral growth of the roof after loss of control of one or both of two different cavities will almost certainly occur at different levels. Hence, the cavity at the lower level must be grown to a greater lateral distance than necessary (taking a longer time) before connection is made.

SUMMARY OF THE INVENTION

It has been found that cavity roof control can be maintained for the purpose of cavity connection by first creating at the bottom of the borehole at which the cavity is to be developed a chimney having a height from the bottom of the borehole to at least the lowest level at which connection is to take place. This chimney acts as a reservoir for the immiscible fluid non-solvent blanket so that the thickness of the blanket is not inadvertently reduced, since the fluid is continually supplied from the reservoir. This is accomplished by filling the reservoir with immiscible non-solvent fluid, introducing solvent below the fluid level and withdrawing enriched solution, thereby developing a cavity in the potassium chloride-lean, sodium chloride-rich stratum immediately below a potassium chloride-rich stratum. The fluid blanket is then raised incrementally and gradually as the cavity expands laterally to create inverted cone shaped cavities. At least one of the two adjacent cavities are developed into the potassium chloride-rich stratum in this manner while they are simultaneously developed. Then at approximately the same depth, the cavities are allowed to expand until connection is effected.

DESCRIPTION OF THE DRAWINGS

The invention will be better understood from the detailed description made below with reference to the drawings in which.

DETAILED DESCRIPTION OF THE INVENTION

Figure 1:
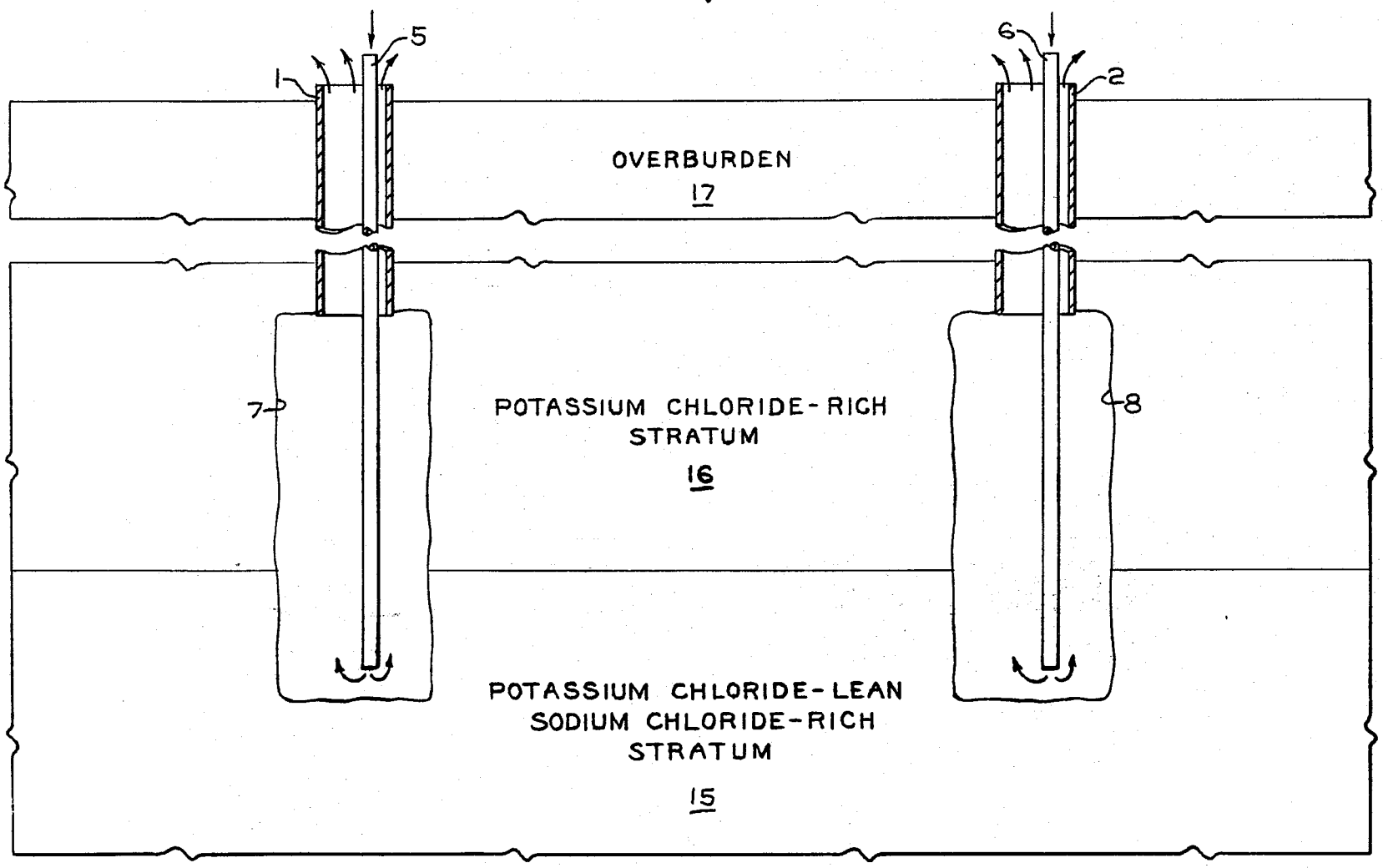
FIG. 1 diagrammatically illustrates chimneys being established at the bottom of two adjacent cased well bores.

In accordance with the present invention, a chimney is developed at the bottom of a borehole to aid in early connection of two or more developing cavities. Reference is now made to FIG. 1 where two adjacent wells between about 60 meters and 130 meters apart are drilled down through overburden 17 and through potassium chloride-rich stratum 16 into potassium chloride-lean sodium chloride-rich stratum 15 and to the bottom of what is shown as chimneys 7 and 8. The depth of the ultimate cavity (shown in FIG. 3) into stratum 15 is determined by (1)the minefield brine balance in terms of how much potassium chloride-lean brine can be tolerated and maximizing the potassium chloride-rich brine produced; (2) the desirability to quickly develop the cavity and hence to develop in a quickly dissolving sodium chloride stratum and (3) the desirability to quickly produce potassium chloride to obtain a quick return on investment in drilling and cavity development costs. Hence, one skilled in the art can determine from the above the optimum cavity depth into stratum 15.

The well bores are cased with casing 1 and 2 to the depth at which the top of the chimneys 7 and 8 are to be established. Again, those skilled in the art of solution mining can determine what this depth should be, which determines the height of the chimney from the bottom of the well bore. These chimneys 7 and 8 should have a height at least higher than the height of inverted cone cavities 12 and 13 (FIG. 3) which have grown large enough to connect.

The aforementioned chimneys 7 and 8 are established by disposing into each cased well bore at least one conduit 5 and 6 extending from the surface to the bottom of the well bore. A solvent which is unsaturated with respect to sodium chloride and potassium chloride, preferably water, is introduced into the bottom of the well bore through the conduit 5 and 6 and enriched solution is withdrawn through the annular space between the conduits and casings 1 and 2. By bottom injection in this manner, the solvent rises up the walls of the well bore to create substantially cylindrical chimneys 7 and 8. These chimneys are expanded to a larger diameter than the initial well bore, i.e., to about a 3 meter diameter which (1) defines a volume sufficient to reserve enough immiscible non-solvent blanket fluid for the purpose of the invention and (2) create a recess so that solvent to be later injected near the top of the cavity does not disrupt the insulating blanket immediately around the well bore.

Figure 2:
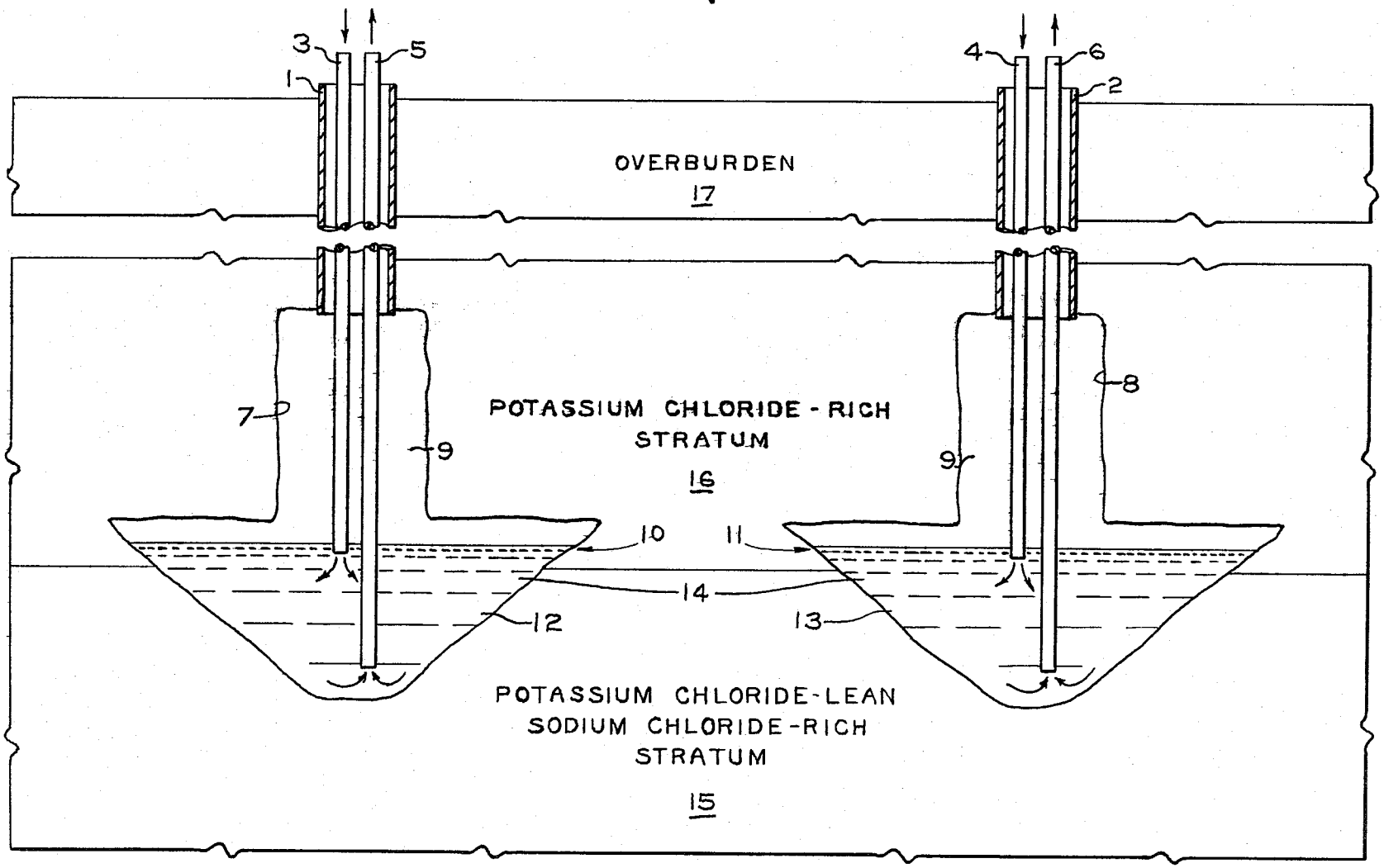
FIG. 2 diagrammatically illustrates two subterranean cavities being expanded laterally using chimneys.

Reference is now made to FIG. 2 which shows additional conduits 3 and 4 disposed in the well bores and which shows immiscible non-solvent fluid 9 in the annular space of the casings 1 and 2 to establish levels 10 and 11 within chimneys 7 and 8. Conduits 3 and 4 extend below levels 10 and 11 respectively. These levels 10 and 11 are first established near the bottom of chimneys 7 and 8 as solvent is introduced through conduits 3 and 4 and enriched solution is withdrawn through conduits 5 and 6 to allow cavities 12 and 13 to expand laterally. Levels 10 and 11 are then incrementally raised by methods known in the art, suchas by using an additional control conduit, to effect further lateral development at higher levels, thereby creating inverted cone shaped cavities 12 and 13. This is caused by relatively dilute and less dense solvent establishing itself on top of solution 14 and dissolving at faster rates than the saturated solution at the bottom of cavities 12 and 13. It is preferred that during this stage water is used as a solvent since development of cavities 12 and 13 should be made as quickly as possible. The chimney reservoirs 7 and 8 effectively control roof development owing to the aforestated reasons.

Figure 3:
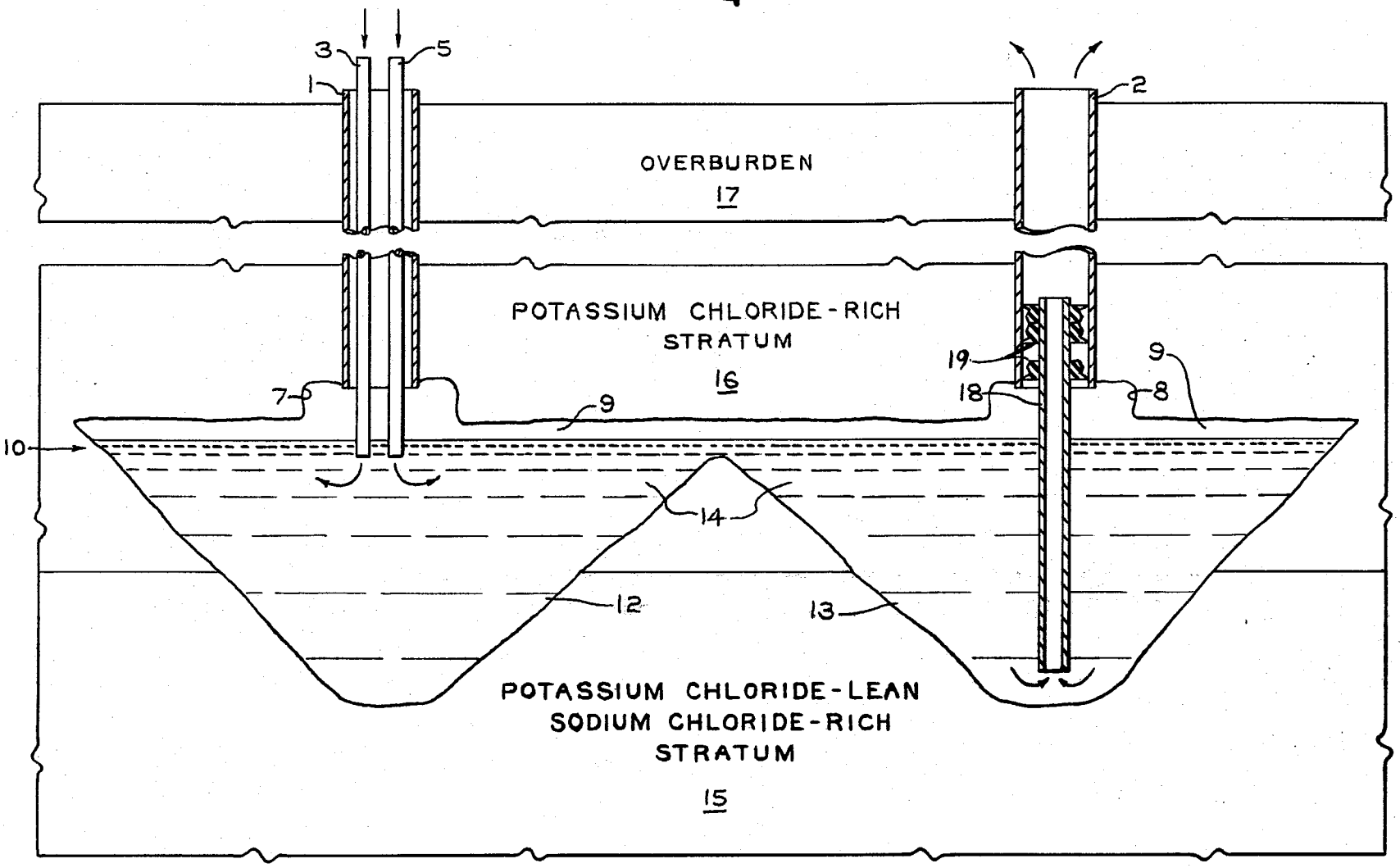
FIG. 3 diagrammatically illustrates the two subterranean cavities of FIG. 1 after connection.

Reference is now made to FIG. 3 which shows cavities 12 and 13 having been connected at the base of their inverted cone shapes. Preferably, this connection is made at an elevation near the bottom of casing 1 and 2. This connection is made by keeping the level of the blanket 9 in both cavities at the same depth. The depths are monitored by neutron logging techniques or other well known methods in the art. Once connection is made, conduit 5 is cut-off with a shaped charge on a line or is otherwise raised in elevation and solvent is introduced through conduits 3 and 5. Conduits 4 and 6 are removed from casing 2 and liner 18, which extends from the bottom of casing 2 to the bottom of cavity 13 and which is sealed by packer 19, installed is by methods familiar to those skilled in the art. Hence, solvent introduced through conduits 3 and 5 is withdrawn up through liner 18 and up through casing 2 to the surface. This gives the solvent a longer residence time and a large contact surface area. The level of immiscible fluid 9 is controlled through the annular space of casing 1. Packer 19 seals casing 2 from blanket fluid 9. After installation of liner 18, the level of fluid 9 can be incrementally raised as the cavities are continually mined upwardly until the top of chimney 7 is reached.

Figure 4:
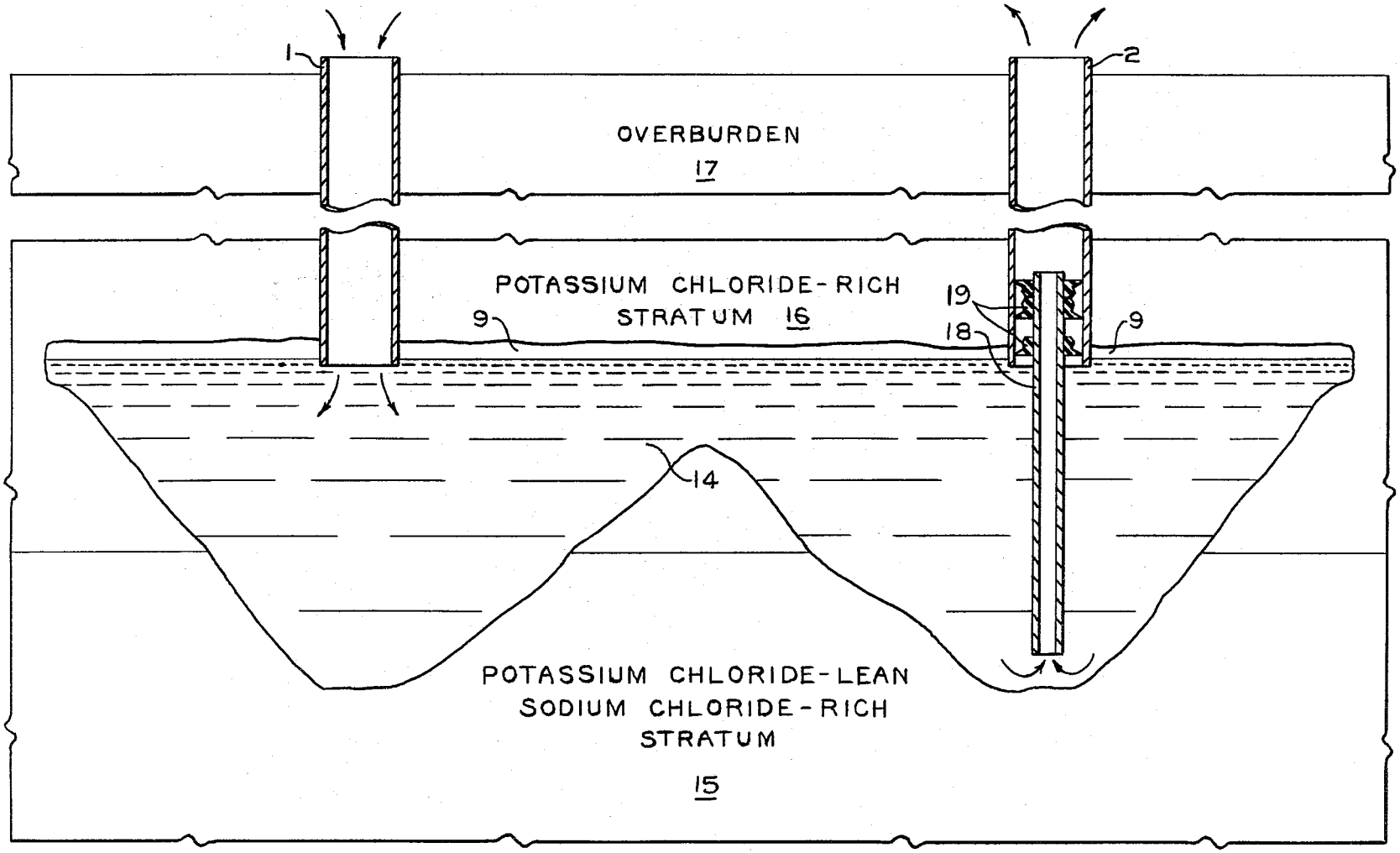
FIG. 4 diagrammatically illustrates the connected subterranean cavities of FIG. 3 as it is ultimately mined.

When the top of chimney 7 is reached by cavity solution 14, conduits 3 and 5 can be removed from casing 1 and solvent is introduced through casing 1 while enriched solution is withdrawn up through liner 18 and up through casing 2, as shown in FIG. 4. Roof raises are subsequently made by perforating or cutting casing 1 with a shaped charge on a line. Fluid 9 may also be introduced through casing 1 to insure that asthe connected cavity grows laterally, the blanket does not become too thin and subsequently loses its insulating effect.

At this point, various types of solution mining can be conducted by methods known in the art, depending on conditions that exist, e.g., temperature of the deposit, surface area exposed and grade of ore exposed. Selective or non-selective mining can be conducted. Solvents saturated or unsaturated with respect to sodium chloride can be used. Sodium chloride that was produced from development cavity brine can be disposed into this enlarged cavity.

By the practice of this invention, connection of two or more cavities is made with relative ease in comparison to the prior art and connection is made without great risk of losing control of the roof of the cavity, especially around the borehole. By the method of the present invention, it is possible to reduce cavity connection time by 25% or higher and to maintain cavity roof control at the base of high grade ore prior to connection, thus providing a quick return on investment.

It is apparent that this invention may be practiced in a variety of situations. For example, more than two cavities may be interconnected as hereinbefore described. Geological consideration may make a special arrangement or spacing of bore holes desirable in a particular case. The number of inlets into a cavity need not correspond to the number of outlets.

Although the present invention has been described with reference to specific details of certain embodiments thereof, it is not intended that such details should be regarded as limitations upon the scope of the invention, except insofar as they are included in the accompanying claims.

What is claimed:

1. A method of connecting two subterranean cavities in a deposit having a potassium chloride-rich stratum that contains sodium chloride and which is disposed above a potassium chloride-lean, sodium chloride-rich stratum, which comprises the steps of:

(a) drilling adjacent boreholes into the sodium chloride-rich stratum, (b) forming a substantially cylindrical chimney in each borehole by injecting aqueous solvent unsaturated with respect to sodium chloride and potassium chloride into the bottom of the borehole and withdrawing solvent enriched in potassium chloride and sodium chloride from the borehole at a level in the deposit that is at least the lowest level at which connection of the cavities is to be effected, said chimney having a diameter larger than the initial borehole and a volume sufficient to prevent inadvertent reduction in thickness during cavity development of the water-immiscible, non-solvent liquid blanket established in step (c), (c) introducing water-immiscible, non-solvent liquid having a density lower than the aqueous solvent into said chimneys, therby establishing a reservoir and blanket of said non-solvent on top of the aqueous solvent in said chimneys, (d) introducing aqueous solvent into said chimneys below the surface of said blanket and withdrawing enriched solvent from near the bottom of the chimney, thereby expanding the chimneys laterally adjacent to the bottom of the non-solvent blanket and forming subterranean cavities, (e) continuing to expand said cavities in the manner described in step (d) while raising the level of the non-solvent blanket in the cavities incrementally as the cavities expand laterally, thereby forming inverted cone-shaped cavities, and (f) further expanding the cone-shaped cavities laterally while maintaining the non-solvent blanket in the adjacent cavities at about the same level until the cavities connect.

2. The method of claim 1 wherein more than two boreholes are drilled.

3. The method of claim 1 wherein the solvent is water.

4. The method of claim 1 wherein the boreholes are between 60 and 130 meters apart.

5. The method of claim 1 wherein the chimney is about 3 meters in diameter.

6. The method of claim 1 wherein connection is achieved at the base of the inverted cone-shaped cavities.

7. The method of claim 1 wherein the potassium chloride-rich stratum is disposed immediately above the potassium chloride-lean stratum.

8. The method of claim 1 wherein the chimneys extend from the potassium chloride-lean stratum to the potassium chloride-rich stratum and cavity connection is made in the potassium chloride-rich stratum.

9. The method of claim 8 wherein the potassium chloride-rich stratum is disposed immediately above the potassiumchloride-lean stratum.

10. The method of claim 9 wherein the solvent is water.

11. The method of claims 9 or 10 wherein the chimney is about 3 meters in diameter.

12. The method of claims 9 or 10 wherein the boreholes are between 60 and 130 meters apart.

13. The method of claim 12 wherein the chimney is about 3 meters in diameter.

* * * * *